United States Patent [19]

Detlefsen

[11] Patent Number: 4,850,826

[45] Date of Patent: Jul. 25, 1989

[54] SUCTION PUMP WITH COLLAPSIBLE BELLOWS

[76] Inventor: Charles R. Detlefsen, 90045 Crawfordsville Dr., Sweet Home, Oreg. 97386

[21] Appl. No.: 164,545

[22] Filed: Mar. 7, 1988

Related U.S. Application Data

[63] Continuation-in-part of Ser. No. 48,661, Aug. 28, 1987, abandoned.

[51] Int. Cl.[4] ..... F04B 21/04

[52] U.S. Cl. ..... 417/555.1; 92/247

[58] Field of Search ..... 417/479, 488, 550, 552, 417/565, 566, 545, 480, 555.1, 555.2; 92/247, 248, 249

[56] References Cited

U.S. PATENT DOCUMENTS

| | | | |
|---|---|---|---|
| 1,507,134 | 9/1924 | Mowers | 417/555.1 |
| 1,756,678 | 4/1930 | Cumming | 417/479 |
| 2,463,458 | 3/1949 | Freyn | 417/479 |
| 2,476,545 | 7/1949 | Hayward | 417/479 |
| 2,634,684 | 4/1953 | Alvarez et al. | 417/479 X |
| 2,913,293 | 11/1959 | Dibley et al. | 417/555.1 |
| 2,915,986 | 12/1959 | Sisson | 417/550 |
| 2,951,620 | 9/1960 | Sego | 417/550 |
| 3,029,742 | 4/1962 | Curtis | 417/479 |
| 3,062,415 | 11/1962 | Anderson | 417/480 |
| 3,094,076 | 6/1963 | Hyde | 417/566 |

FOREIGN PATENT DOCUMENTS

| | | | |
|---|---|---|---|
| 371688 | 4/1932 | United Kingdom | 417/565 |

*Primary Examiner*—Leonard E. Smith

*Attorney, Agent, or Firm*—Chernoff, Vilhauer, McClung & Stenzel

[57] ABSTRACT

A hand operated pump for liquids including dirty water and the like, which includes a cylindrical chamber having a foot valve at its lower end and reciprocal plunger including a rod mounted slidably in the upper end of the cylindrical chamber. The plunger includes a rod and a bellows of flexible sheet material including a generally circular central portion which is attached at its center to the end of the rod. A plurality of legs extending radially from the central portion are also attached to the rod a short distance from its end, so that the bellows can fill with liquid and expand radially to engage the interior of the chamber sealingly as the plunger moves up, and leaving the bellows free to collapse radially inwardly against the rod as the plunger moves downward within the lift chamber.

3 Claims, 1 Drawing Sheet

SUCTION PUMP WITH COLLAPSIBLE BELLOWS

This application is a continuation-in-part of U.S. patent application Ser. No. 048,661 filed Aug. 28, 1987, now abandoned.

BACKGROUND OF THE INVENTION

The present invention is directed to a suction pump which resists clogging and is capable of effectively pumping liquid containing rocks and other solids with greater efficiency and reduced wear. The device is particularly suited for use in mining and similar applications requiring efficient, durable and inexpensive hand-operated pumps capable of withstanding the additional wear of pumping abrasive slurries or solutions containing solids while achieving sufficient suction to operate at productive volumes.

Suction pumps of the prior art, as shown, for example, in Hayward, U.S. Pat. No. 2,476,545 and Anderson U.S. Pat. No. 3,062,415, fail to disclose a flexible suction inducing element which relaxes or collapses during the return stroke of the handle so as to minimize the resistnace of the suction element to downward movement within a tubular housing containing rocks or other solids. Such devices, instead, employ valve controlled ports within the suction element to alternately open or close the desired passageway at each stroke. All such prior art devices are ineffective in reliably preventing clogging when pumping combinations of liquids and solids. Further, such prior art devices sustain considerable wear when used in such applications and frequently fail to provide the required suction to transport the heavier solids in such mixtures.

SUMMARY OF THE INVENTION

The present invention is directed to a suction pump which solves all of the aforementioned deficiencies of the prior art. The need for a suction pump which more efficiently pumps liquids in combination with rocks or other solids is achieved by employing a flexible bellows to create the necessary vacuum in lieu of a conventional piston head arrangement. The bellows is substantially in the form of a circle with a selected number of radially extending legs projecting therefrom, the ends of which are secured to one end of a pump handle. When the handle is raised within the tubular body of the pump, the bellows billows inside the tube thereby creating a suction or vacuum within the pump below the bellows. The flexibility of the bellows creates a sufficient seal against the inner walls of the plastic tube to sustain the creation of a vacuum even when solids are interposed therebetween. The resiliency of the bellows minimizes the resistance to the presence of the material so caught therebetween thereby reducing radial forces applied to the solids against the plastic tube walls. Instead, a substantially vertical component of force is applied to such solids which effectively assists in the transport of such material upwardly through the pump. On the down stroke of the pump handle the connection of the bellows by means of the radially extending legs facilitates a collapse or relaxation of the bellows which minimizes downward resistance from the combination of liquids and solids within the pump and which further serves to sustain the pump's prime. The number and spacing of the radially extending legs can be varied so as to achieve the desired operating characteristics for the anticipated liquid to be encountered.

The foregoing and other objectives, features and advantages of the present invention will be more readily understood upon considertion of the following detailed description of the invention taken in conjunction with the accompanying drawings.

DETAILED DESCRIPTION OF THE INVENTION

Figure 2:
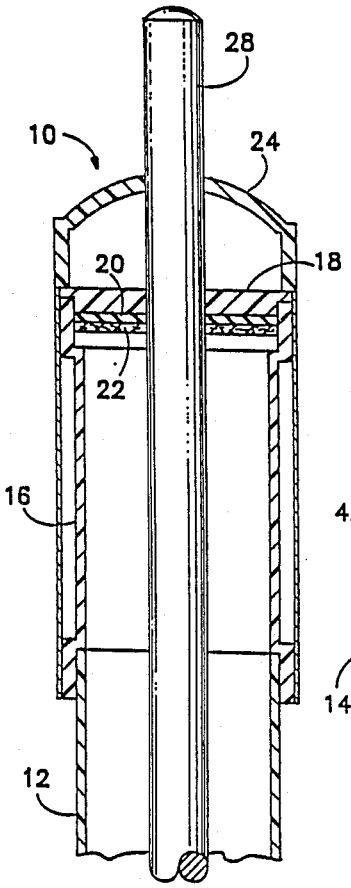
FIG. 2 is a side view of an upper segment of the device of FIG. 1.
Figure 2:
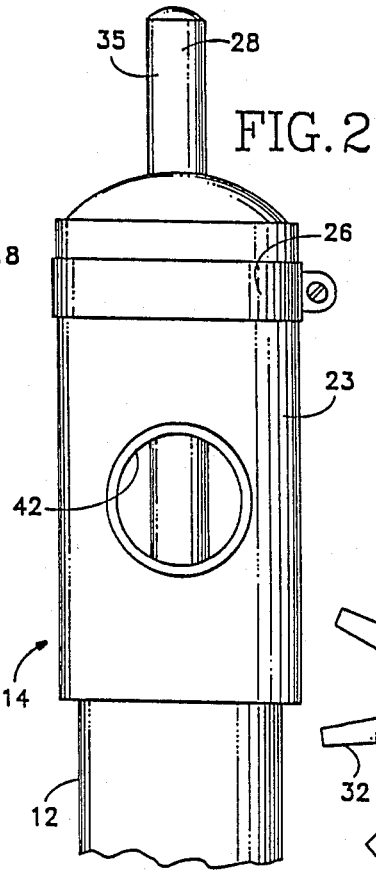
Figure 3B:
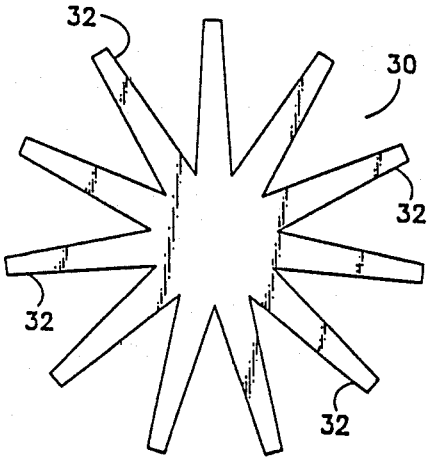
FIG. 3*b* is an illustration of one alternative pattern for an unassembled bellows for use in accordance with the present invention.
Figure 1:
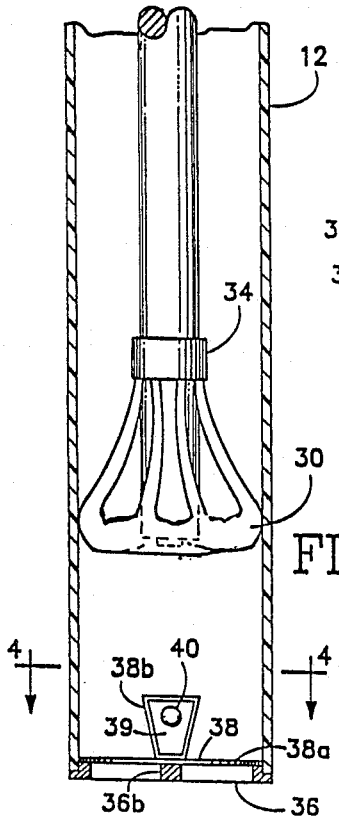
FIG. 1 is a schematic side view of an examplary embodiment of a suction pump constructed in accordance with the present invention.
Figure 4:
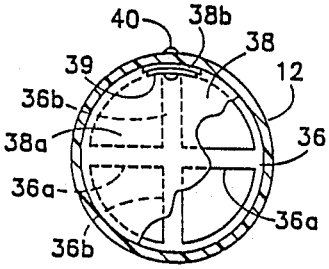
FIG. 4 is a sectional view taken along line 4—4 of FIG. 1.
Figure 3A:
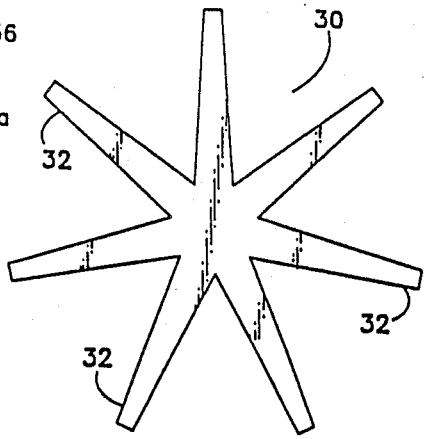
FIG. 3*a* is an illustration of a pattern for an unassembled bellows for use in accordance with the present inventions.

Referring to the drawings, wherein like numerals refer to the same elements, and in particular to FIG. 1, a preferred embodiment of the present invention is shown as comprising a hand-operated suction pump 10 for inducing an upward flow of fluids or of fluids in combination with solids. The pump 10 includes a cylindrical housing 12 made of standard 3-inch plastic pipe cut to a length of 30 inches. As seen in FIG. 2, a head assembly 14 is secured to the top of the housing 12. The assembly 14 includes a standard 3-inch by 2-inch plastic pipe tee 16 fitted to the top and with a 3-inch diameter plastic stop 8 having rubber seal 20 and leather insert 22 glued to the inside face thereof. The seal 20, insert 22 and bottom side of stop 18 have a diameter substantially equal to the outside diameter of the flared top of the pipe tee 16. a sheet 23 of 24-gauge sheet metal matching the size of the pipe tee is cut to fit around the spout 42 and is wrapped around the outer surface of pipe tee 16 as shown in FIG. 2 and secured using poprivets. A cap 24 is fitted at the top of head assembly 14, adjacent to stop 18, using a clamp 26. The cap 24, stop 18, seal 20 and insert 22 are each provided with an axially aligned aperture to accept a rod 28 within the interior of the pipes 12 and 16. The rod 28 within the interior of the pipes 12 and 16. The rod is preferably made from broom handle stock cut to a length of 41¾ inches. A bellows 30, preferbly cut from a discarded inner tube in a pattern of a circle with a selected number of radially extending legs projecting therefrom, as best seen in FIGS. 3*a* and 3*b*, is attached by the legs to the sides of the handle adjoining the blunt end. The legs 32 are stapled using industrial strength staples to an adjoining side of the handle. Once all the leg tips are fastened to the handle 28, heavy duty duct tape 34 is wrapped around the leg tips to seal off the area around the connection of the bellows to the handle. The center of the bellows 30 is secured to the blunt end of the handle by driving a 6-penny nail through a hole of a small, flat washer, through the center of the bellows and into the center of the blunt end of the rod 28. The rod and bellows constitute a plunger assembly which is then inserted into the housing 12 and through the aligned apertures of the head assemblly 14, thereby positioning the bellows in the interior of pump 10, with the blunt end of the rod facing downward. The segment of the rod 28 protruding from the top of assembly 14 is then provided with a rubberized handle grip 35. A flange 36 having a circular lip conforming to the periphery of the bottom edge of tubular housing 12 is preferably made of an aluminum alloy. A flange is glued onto the bottom of the tubular housing 12 using an epoxy based cement. The flange 36 includes a pair of intersecting cross bars 36*a*, 36*b* for supporting a flap 38. The flap 38 is comprised of the circular portion 38*a* having a segment of the circumference integral with an appendage segment 38*b*. The flap is constructed from discarded inner tube, the circular portion 38*a* being of sufficient diameter so as to completely close the inner diameter of the bottom of housing 12 when resting on the crossbars 36*a*, 36*b* of flange 36. the flap is secured to pivot from such resting position by securing the flap section 38*b* to the wall of the housing 12. Such attchment is accomplished by placing the segment 38*b* between the lower inside surface of housing 12 and a piece of sheet metal 39 of somewhat smaller size than the segment 38*b* and then applying poprivet 40 therethrough.

In operation, the lower end of housing 12 comprises an input baffle which is immersed in a depth of liquid or combination of liquid and solids suficient to prime the pump 10, generally a minimum of one inch. The outer lip portion of the flange 36 serves to prevent damage to the ends of the softer plastic housing 12. The flange also serves to screen the size of solid material permitted to enter the pump by means of the restriction created by crossbars 36*a*, 36*b*. The operator anchors the pump 10 for use with one hand, gripping preferably an upper portion of the head assembly 14. With the other hand, the user grasps the handle grip 35 secured to the segment of rod 28 protruding from the to of assembly 14 and moves the rod axially outward relative to the head assembly 14. As the rod is raised, the bellows billows inside the tubular housing creating an effective sliding seal along the perimeter of the vellows so as to create a partial vacuum within the lower end of the housing 12. The partial vacuum creates a pressure imbalance on opposite sides of flap 38*a* which partially disengages the flap 38*a* from the flange 36 thereby drawing a stream of fluid or of a combination of liquid and solids into the housing 12. When the bellows nears the output aperture 42 and the head assembly 14 the rod 28 is fully etended and the housing 12 below the bellows is substantially filled with liquid and any combined solids. The rod is then lowered with the action creating a high-pressure condition in the housing 12 below the bellows which causes the flap 38*a*, acting as an inlet valve, to return to a resting position on flange 36 thereby closing the inner diameter of the bottom of housing 12. Such closure prohibits the escape of the accumulated solids and liquid within the pump. Continued downward movement of the rod displaces the contents of the pump upward. The flexibility of the bellows combined with it deflation or partially collapsed state created by the action of the downstroke releasing tension on the legs 32, facilitates the upward movement of liquid and solids by yielding along the perimeter to the passage of such upward flow. The minimal resistance offered by the collapsed bellows minimies the effort required to achieve the downward movement of the rod 28. The creation of high pressure below the bellows, reated by virtue of the closed flange 36, then, is relieved by the upward movement of the contents of the pump toward the open spout 42. When the initial downward stokes are completed, the pump is now primed and subsequent upwrd stokes of the rod 28 not only draw a stream of liquid and solids into the pump housing 12, but also moves liquid and material above the bellows upward and out the spout 42. The resilient engagement of the perimeter of the bellows along the inner wall of housing 12 yields to solids which become inerposed therebetween thereby minimizing the radial force components applied to solids in opposition to the inner walls of housing 12 while simultaneously accommodating the transmission of upward vertical force components Transmission of vertically downward force components by the bellows to solids during downstroes are minimied by virtue of the partially collapsed state of the bellows offering little downward resistance to encountered solids. In this manner, damage to the walls caused by abrasive solids is reduced. The operating characteristics of the pump 10 can be tuned to accommodate the desired application by varying the configuration of the bellows. It is expected that fewer legs 32 associated with the bellows 30 as shown in FIG. 3*a*, for example, would offer less resistance on a down stroke and would thereby transmit larger solids than would the bellows illustrated in FIG. 3*b*.

The terms and expressions which have been employed in the foregoing specification are used therein as terms of description and not of limitation, and there is not intention, in the use of such terms and expressions, of excluding equivalents of the features shown and described or portions thereof, it being recognized that the scope of the invention is defined and limited only by the claims which follow.

What is claimed is:

1. A manually operated pump for liquids, comprising:

(a) a housing defining an elongate generally clyindrical chamber therein;

(b) one-way inlet valve means for admitting fluid into said chamber; and (c) a plunger assembly associated with said housing, a part thereof being disposed within said chamber and reciprocally movable longitudinally thereof, said plunger assembly including a rod having an end and a bellows attached to said rod, said bellows comprising a piece of resilient sheet material defining a generally circular central portion and a plurality of legs etending radially therefrom, said central portion being secured to said end of said rod, and said legs being attached to said rod at a position spaced a short distance apart from said end so as to support said central portion of said bellows in sliding sealing contact with said chamber when said plunger assembly is moved in the direction away from said first end, while said central portion remains free to callapse toward said rod when said plunger assembly is moved in the direction of said first end during use of said pump.

2. The pump of claim 1 wherein said chamber has a bottom end, said inlet valve means comprising a flap support located inside said chamber adjacent said bottom end, and flap closure means, attached to the interior of said chamber at a position upwardly adjacent said flap support, for closing said valve means by resting on said flap support and thereby obstructing said bottom end.

3. The pump of claim 2 wherein said housing is of plastic material and said flap support is attached to said bottom end and comprises a flange extending protectively over said bottom end and a pair of cross bars extending protectively across said bottom end.

* * * * *

UNITED STATES PATENT AND TRADEMARK OFFICE

CERTIFICATE OF CORRECTION

PATENT NO. : 4,850,826

DATED : July 25, 1989

INVENTOR(S) : Charles R. Detlefsen

It is certified that error appears in the above-identified patent and that said Letters Patent is hereby corrected as shown below:

Col. 2, line 8: change "examplary" to --exemplary--;
Col. 2, line 39: change lowercase "a" to capital --A--;
Col. 2, line 66: change "assemblly" to --assembly--.
Col. 3, line 15: change "the" to --The--;
Col. 3, line 17: change "attchment" to --attachment--;
Col. 3, line 24: change "suficient" to --sufficient--;
Col. 3, line 34: change "to" to --top--;
Col. 3, line 38: change "vellows" to --bellows--;
Col. 3, line 45: change "etended" to --extended--;
Col. 3, line 56: change "it" to --its--;
Col. 3, line 62: change "minimies" to --minimizes--;
Col. 3, line 64: change "reated" to --created--;
Col. 3, line 67: change "stokes" to --strokes--;
Col. 3, line 68: change "upwrd" to --upward--.

Col. 4, line 10: insert --period-- between "components" and "Transmission";
Col. 4, line 12: change "downstroes" to --downstrokes--; change "minimied" to --minimized--;
Col. 4, line 26: change "not" to --no--;
Col. 4, line 33: change "clyindri-" to -- cylindri- --;
Col. 4, line 44: change "etending" to --extending--;

UNITED STATES PATENT AND TRADEMARK OFFICE

CERTIFICATE OF CORRECTION

PATENT NO. : 4,850,826

DATED : July 25, 1989

INVENTOR(S) : Charles R. Detlefsen

It is certified that error appears in the above-identified patent and that said Letters Patent is hereby corrected as shown below:

Col. 4, line 52: change "callapse" to --collapse--.

Signed and Sealed this

Fourteenth Day of July, 1992

*Attest:*

DOUGLAS B. COMER

*Attesting Officer*

*Acting Commissioner of Patents and Trademarks*